US005727744A

United States Patent [19]

Threlkeld et al.

[11] Patent Number: 5,727,744

[45] Date of Patent: Mar. 17, 1998

[54] METHOD AND APPARATUS TO CONTROL THE WINDING PATTERN ON A YARN PACKAGE

[76] Inventors: James O. Threlkeld; James Preston, both of 4100 Barringer Dr., Charlotte, N.C. 28217

[21] Appl. No.: 614,695

[22] Filed: Mar. 13, 1996

[51] Int. Cl.[6] ..... B65H 54/38

[52] U.S. Cl. ..... 242/18.1

[58] Field of Search ..... 242/18.1, 43 R

[56] References Cited

U.S. PATENT DOCUMENTS

| | | | |
|---|---|---|---|
| 3,243,131 | 3/1966 | Greive . | |
| 3,347,478 | 10/1967 | Sternberg . | |
| 3,353,759 | 11/1967 | Sternberg . | |
| 3,367,588 | 2/1968 | Wolf . | |
| 3,397,529 | 8/1968 | Wolf . | |
| 3,445,999 | 5/1969 | De Ruig . | |
| 3,876,166 | 4/1975 | Kadokura et al. . | |
| 4,504,024 | 3/1985 | Gerhartz | 242/18.1 |
| 4,515,320 | 5/1985 | Slavik et al. | 242/18.1 X |
| 4,779,813 | 10/1988 | Sugioka et al. | 242/18.1 |
| 4,798,347 | 1/1989 | Schippers et al. | 242/18.1 X |
| 4,805,844 | 2/1989 | Hermanns et al. | 242/18.1 X |
| 5,056,724 | 10/1991 | Prodi et al. | 242/18.1 |
| 5,328,111 | 7/1994 | Franzolini | 242/18.1 |
| 5,439,184 | 8/1995 | Poppinghaus et al. | 242/18.1 |

*Primary Examiner*—Michael Mansen

*Attorney, Agent, or Firm*—Kennedy Covington Lobdell & Hickman LLP

[57] ABSTRACT

An apparatus for controlling the winding pattern on a yarn package for traverse winder used for winding elastomeric yarn to prevent repetitive patterns of individual yarn segments on the package includes an apparatus for monitoring the operation of a yarn package spindle, an apparatus for monitoring the operation of a traverse arm associated with a winder, an arrangement for predicting the occurrence of repetitive patterns of yarn strands, and an arrangement for adjusting the relative speed of the yarn package spindle and the traverse arm to prevent the occurrence of thusly predicted repetitive patterns.

4 Claims, 5 Drawing Sheets

METHOD AND APPARATUS TO CONTROL THE WINDING PATTERN ON A YARN PACKAGE

BACKGROUND OF THE INVENTION

The present invention relates broadly to methods and apparatus for controlling yarn package winders and, more specifically, to a method and apparatus for controlling such a winder to effect the relative positioning of the yarn strand during consecutive winds.

Surface winding of natural rubber yarn, spandex, or other elastomeric yarns is a difficult process with unique problems caused by the ability of the yarn to stretch. If the yarn stretches too much during winding, the wound yarn will be under internal tension and such poorly wound yarn can destroy the core about which it is wound or, in the case of rubber yarn, fuse together internally within the package thereby becoming unusable. A typical tension control technique for surface winding rubber yarn concerns the increase or decrease of the speed of the drum driving the yarn package. Since the yarn is under some tension when being wound, increasing the speed can increase the amount of tension experienced by the yarn.

One way the situation wherein the yarn is wound too tightly can become manifest is in the appearance of the wound yarn package itself. Since the yarn is being wound on a traverse, the traverse arm makes one complete cycle for a predetermined number of yarn package or spindle revolutions. The ratio of spindle revolutions to strokes of the traverse is known as the wind ratio. If the wind ratio remains constant throughout the winding process, the resultant process is known as a "precision wind."

As may be appreciated, varying this ratio can affect the pattern formed by the yarn when wound on a core. Typically, the proper appearance of a wound package appears in FIG. 3 wherein the yarn remains as individual strands tracing an individual path. Problems can arise when the yarn appears as in FIG. 4. There, the yarn no longer experiences individual yarn trajectories and ribbons can be formed. These ribbons are repetitive patterns in the wind resulting in a side-by-side closely adjacent parallel orientation of yarn. Due to the stretchability of the yarn and the aforesaid increased tension, packages wound with ribbons can experience localized internal stresses which can damage or destroy the yarn package. Therefore, when winding elastomeric yarn it is desirable to avoid creating ribbons on the package.

SUMMARY OF THE INVENTION

It is accordingly an object of the present invention to provide a method and apparatus for the elimination of parallel, side-by-side orientation of yarn winding on a yarn package.

It is another object of the present invention to provide such a device and method for prediction of the approach or occurrence of ribbon patterns and to responsively alter winding parameters in response thereto.

It is another object of the present invention to use the wind ratio to predict the upcoming occurrence or approach of ribbons and to correct for the ribbons before they are formed.

As was previously stated, the wind ratio, namely, the revolutions of the spindle to the strokes of the traverse, can be useful in predicting the formation of ribbons or repetitive patterns on the surface of a random wind where the ratio W is constantly changing from its maximum value starting with the empty yarn tube to its minimum value with a maximum diameter of the finished package. Between these limits, whenever twice the ratio passes through any value that can be represented by a rational fraction, a repetitive pattern will be formed on the surface of the package. Since one stroke of the traverse represents one half traverse cycle, multiplying the wind ratio by two accounts for one complete cycle of traverse operation and repetitive patterns must be a multiple of complete traverse cycles. The computation may be simplified by multiplying the ratio (2W) by a factor which must be an integer. The integer factor will provide a simple way to rationalize the fractions into integers so that, if 2WN in equals any integer, a ribbon will be forming. This information may be used to predict the approach of ribbons and, if such an approach occurs, the speed of the traverse may be altered to prevent ribbon formation.

To that end, the present invention provides a method and apparatus to control the winding pattern on a yarn package for traverse winder used for winding elastomeric yarn to prevent repetitive orientation of individual yarn tracks on the package with method comprising the steps of providing an arrangement for monitoring the operation of a yarn package spindle; providing an arrangement for monitoring the operation of a traverse arm associated with a traverse winder; providing an assembly for predicting the occurrence of repetitive patterns of yarn; and providing an arrangement for adjusting the relative speed of the yarn package spindle to prevent the occurrence of the repetitive patterns of yarn. The method further includes the steps of monitoring the operation of the yarn package spindle, monitoring the operation of the traverse arm, predicting the occurrence of a repetitive pattern of yarn strands; and adjusting the relative speed of the yarn package spindle to prevent the occurrence of the repetitive patterns of yarn. It is preferred that the step for monitoring the operation of a yarn package as well as the means to accomplish that step include an arrangement for counting the number of revolutions experienced by the yarn package spindle. Further, the step of providing an arrangement for monitoring the operation of a traverse arm associated with the traverse winder includes providing an assembly for determining the occurrence of a complete traversing movement of the traverse arm associated with the traverse winder, defining a traverse cycle. It is preferred that the step of providing an arrangement for predicting the occurrence of repetitive patterns of yarn includes providing an arrangement for determining a ratio with the ratio being the number of revolutions experienced by the yarn package spindle per traverse cycle to determine a wind ratio and providing an assembly for predicting when the wind ratio will be a rational fraction. Further, the step of providing an assembly for adjusting the relative speed of the yarn package spindle and the traverse arm includes providing an arrangement for changing the speed of the traverse arm. Finally, the previously discussed steps are performed using the apparatus above described. It is further preferred that the wind ratio be doubled and the result multiplied by a predetermined factor with that factor being an integer to determine a derived wind ratio and the method includes providing an arrangement for predicting when the derived wind ratio will be an integer. It is preferred that the step of adjusting the relative speed of the yarn spindle and traverse arm be performed responsive to a determination that the derived wind ratio is approaching an integer.

It is preferred that the apparatus for determining the occurrence of a complete traversing movement of the traverse arm include providing a pulse generator for producing pulses associated with traversing movement. It is further preferred that the assembly for counting the number of revolutions experienced by the yarn package spindle includes providing a pulse counter that has a resolution of at least 0.001 revolution and the assembly for predicting when the wind ratio will be a rational fraction, or the derived wind ratio an integer, includes providing an electrical circuit formed as a comparator with the comparator receiving an input from the yarn package spindle pulse counter and the traverse pulse counter and the method further includes the steps of comparing the pulse counter value to a predetermined baseline value of less than zero to determine a wind ratio factor responsive to the presence of the traverse pulse and when the factor equals zero changing the relative speed of the yarn package spindle and the traverse arm using the arrangement for doing so to prevent repetitive patterns in the yarn.

By the above, the present invention provides a method and apparatus for controlling the appearance of repetitive patterns in a surface wound yarn package of elastomeric yarn.

DETAILED DESCRIPTION OF THE PREFERRED EMBODIMENT

Figure 1:
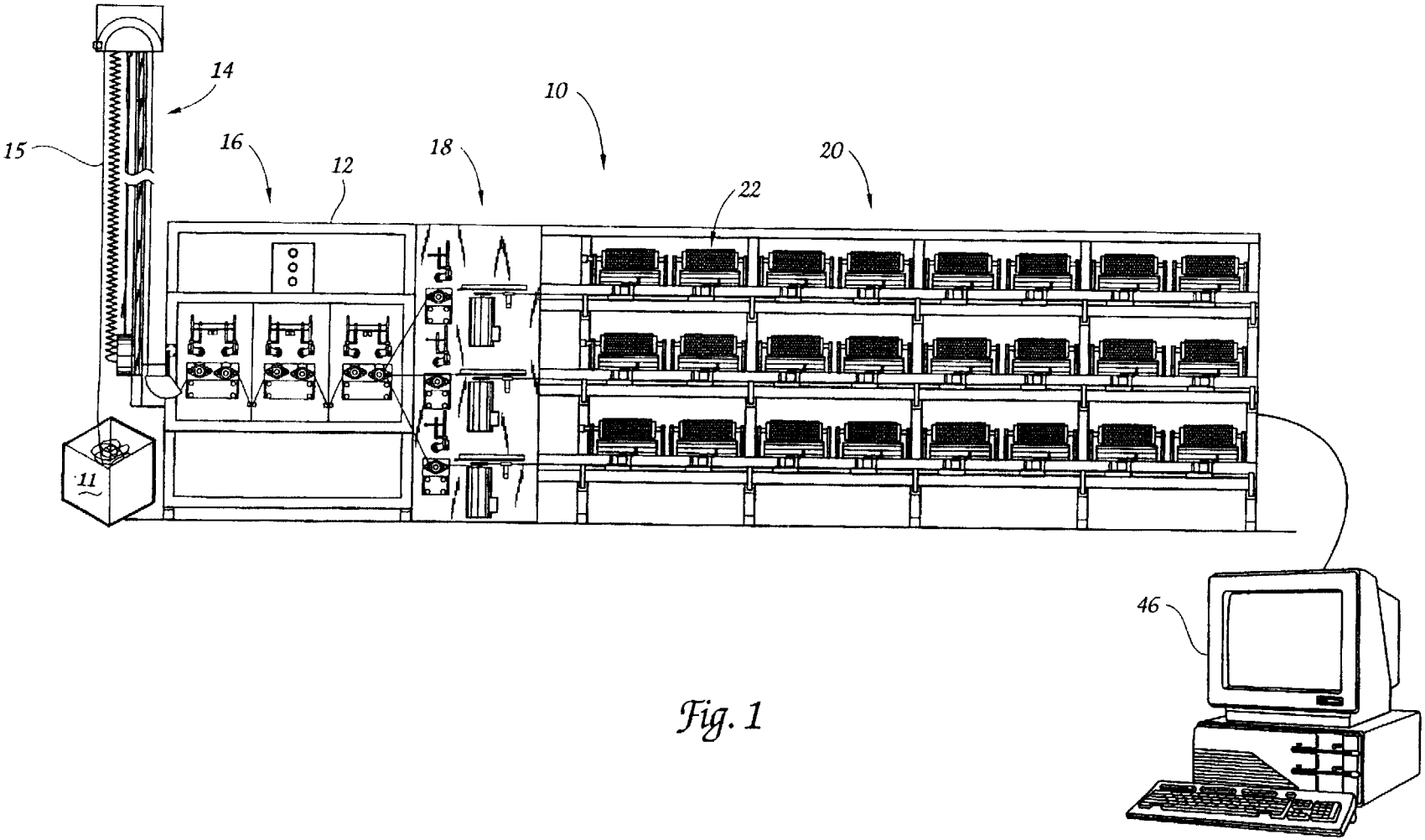
FIG. 1 is an elevational view of a yarn winder for winding elastomeric yarn.

Turning now to the drawings and, more particularly, to FIG. 1, a winder is illustrated generally at 10 and is configured for multiple traverse winding of individual yarn strands of natural rubber, spandex or other elastomeric yarns. The winder 10 includes several discrete systems mounted on a skeletal frame 12. While the remainder of the present invention will be described relative to the use of natural rubber yarn, it will be appreciated that the principles involved herein are equally applicable to spandex or other elastomeric yarns.

Natural rubber yarn is shipped as a fused tape of individual strands providing a flat, ribbon-like elongate strand 15 of several individual strands fused in a side-by-side relationship. The strand 15 is loosely coiled into a box 11 for shipment and is withdrawn from the box 11 by the winder 10. In that regard, the winder includes a support 14 for yarn leaving the box 11 and, from the support 14, the yarn goes through a stretcher 16 and a tractor/distribution mechanism 18 for ultimate winding on any one of a bank of 24 traverse mechanisms 22. A microcomputer 46 is provided for overall control of the winder 10.

Figure 2:
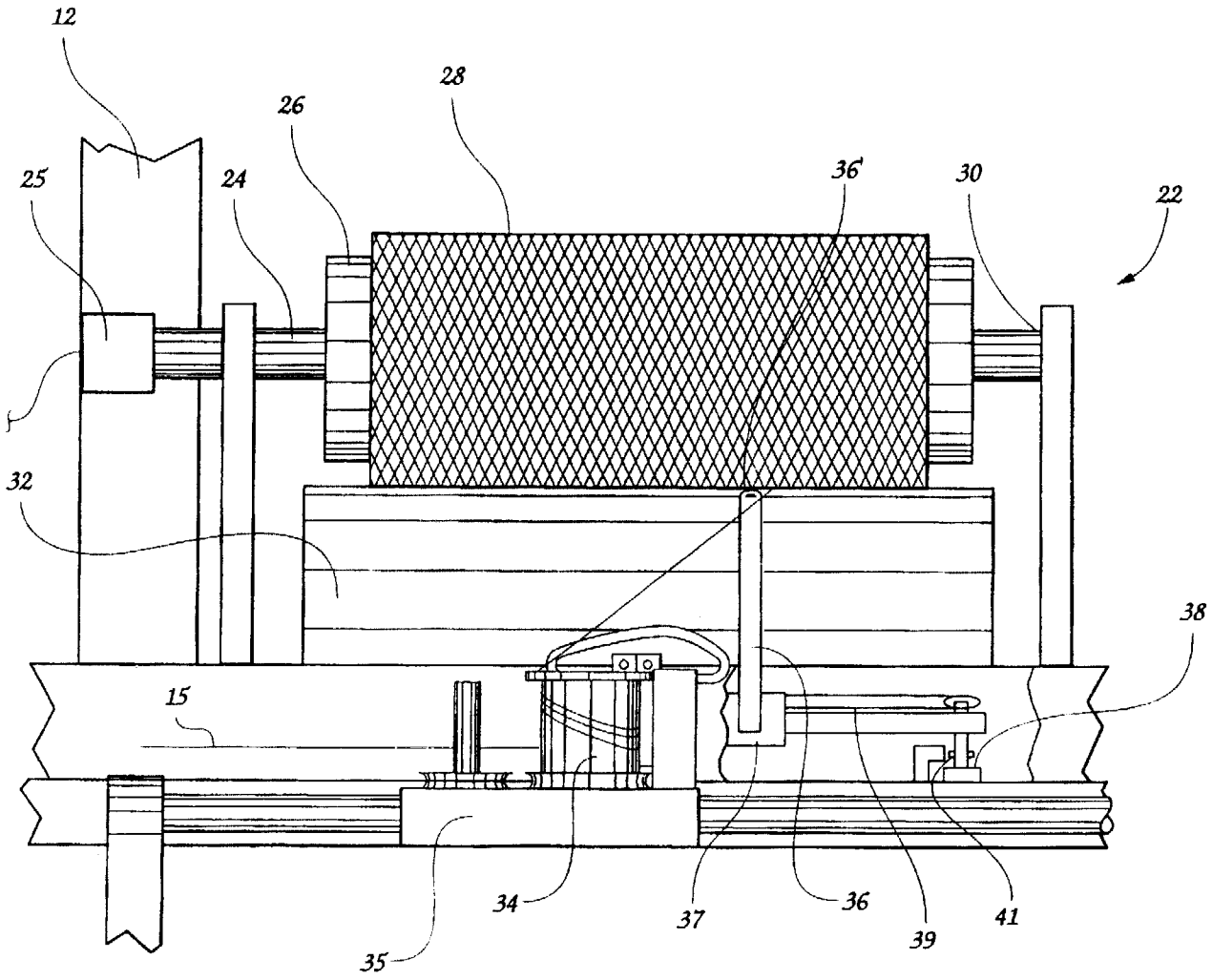
FIG. 2 is an elevational view of a traverse winder.

A traverse mechanism 22 is illustrated in FIG. 2. There, a yarn package 28 is illustrated wound on a core 26 which is mounted to a spindle 24 which is in turn mounted to the frame 12 using journals 30. A pulse counter 25 is shown as a box associated with the spindle 24. At this point it should be noted that the present invention uses no esoteric or complex electronic gear to perform its function. Pulse generators, frequency counters, comparator circuits, and switching are all well within the skill of those skilled in the art of control systems. Therefore, the electronics are provided in diagrammatic form for clarity. Since the traverse mechanism 22 represents a surface drive system, a drive roll 32 is rotatably mounted to the frame 12 and is motor driven. The outer surface of the drive roll 32 frictionally contacts the outer surface of the yarn package 28 to drive the yarn package in a yarn take-up manner. A capstan 34 is rotatably mounted to a bracket 35 which is mounted to the frame 12. The capstan 34 provides a debarkation point for maintaining constant tension on the yarn strand 15 as it is being wound. A traverse arm 36 having an eyelet 36' formed in the distal end thereof is caused to oscillate in a traversing manner to guide the yarn 15 onto the package 28. The traverse arm 36 is mounted to a traversing mechanism 37 which is shown in diagrammatic form in FIG. 2 with a portion of the frame 12 broken open to reveal the traverse mechanism. A motor 38 drives a chain mechanism 39 which drives the traverse arm 36. A pulse generator 40 is attached to the motor arm for generating electronic pulses corresponding to the motor's armature rotation. This is one of many possible systems for generating a predetermined number of electrical pulses per traversing cycle.

Figure 5:
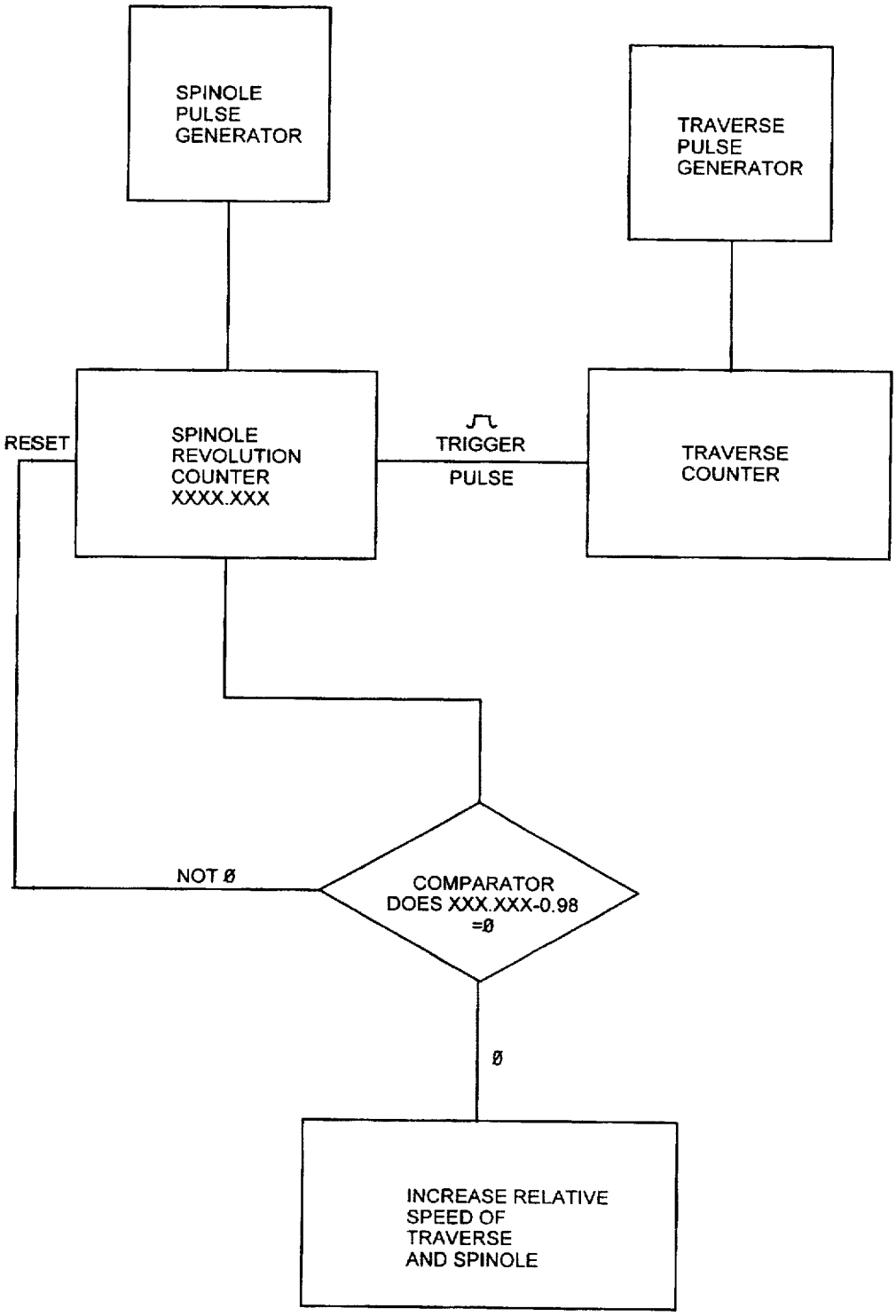
FIG. 5 is a block diagram of the apparatus for predicting the occurrence of repetitive patterns in the yarn wind.

Since it is known that if 2WN equals any integer, a repetitive pattern or ribbon will occur. Therefore, if it could be predicted when such an integer value would occur, the relative speed of the traverse arm movement and yarn package rotational speed could be adjusted to prevent the integer value of the derived wind ratio from occurring. Looking now at FIG. 5, a block diagram of the electronics required to accomplish the anticipation and avoidance of repetitive patterns is illustrated. The spindle 24 is fitted with a pulse generator 25 which produces, for example, 1,000 pulses per revolution. The pulses from this pulse generator 25 are fed into a countermodule so that the accumulated count will represent spindle revolutions with great accuracy, preferably to three decimal places. A similar pulse generator 41 is coupled to the traverse mechanism 37. This pulse generator 41 produces, for example, 250 pulses per revolution and, if the traverse driving mechanism requires two revolutions per stroke and two strokes per cycle, each 1,000 pulses represents one traverse cycle. These pulses are fed to a counter which will produce a trigger pulse every 1,000 counts. Essentially, a trigger pulse is produced for every traverse cycle. The trigger pulse is fed into the counter keeping track of the spindle revolutions. Upon triggering, the three least significant digits, or the fractional portion, of each sample count will be isolated and compared to a predetermined limit with the limit being set at slightly less than zero, i.e., 0.90 to 0.98. If the difference between the fractional portion of the spindle count and the predetermined limit is zero, then an integer value of the wind ratio is approaching. Consider that, if the wind ratio is an integer, the least three significant digits in the pulse count will also be zero and that means the repetitive pattern is occurring. If the least three significant digits are found to be approaching zero, as determined by the comparison or subtraction circuit, then the least three significant digits are approaching zero; therefore, the wind ratio is approaching zero, and therefore the repetitive pattern is approaching. As a result of this comparison, a signal or trigger pulse can be generated in the speed control circuit to slightly increase the speed, i.e., on the order of one percent to prevent the occurrence of the repetitive pattern.

Figure 3A:
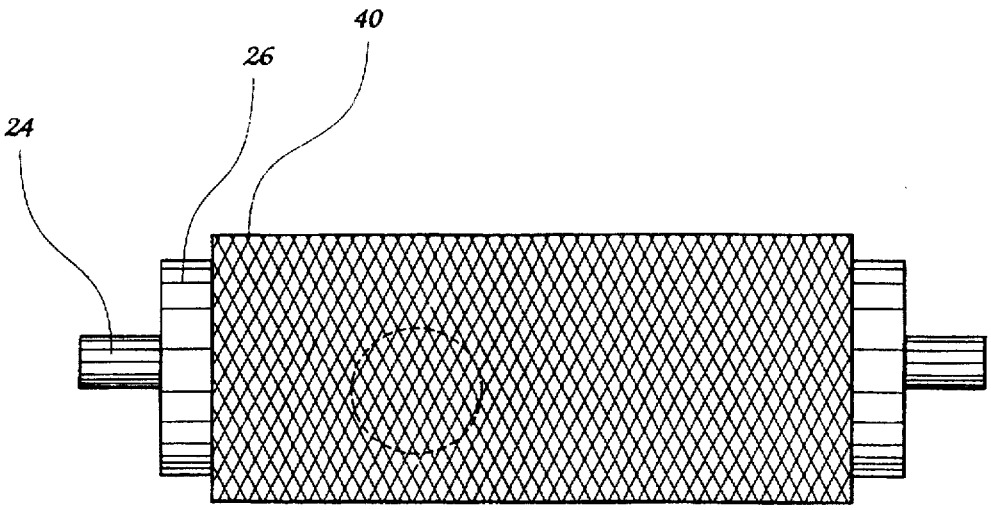
FIG. 3A is an elevational view of a properly wound yarn package illustrating the relationship of individually wound portions of the strand.
Figure 3B:
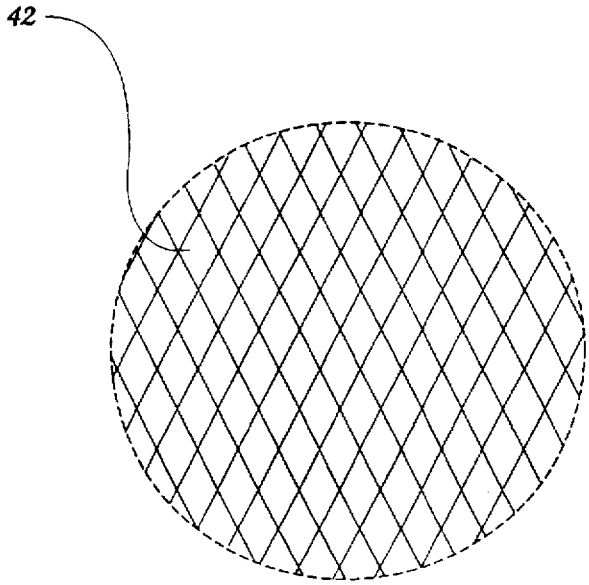
FIG. 3B is a detailed view of the surface of the yarn package illustrated in FIG. 3A.
Figure 4A:
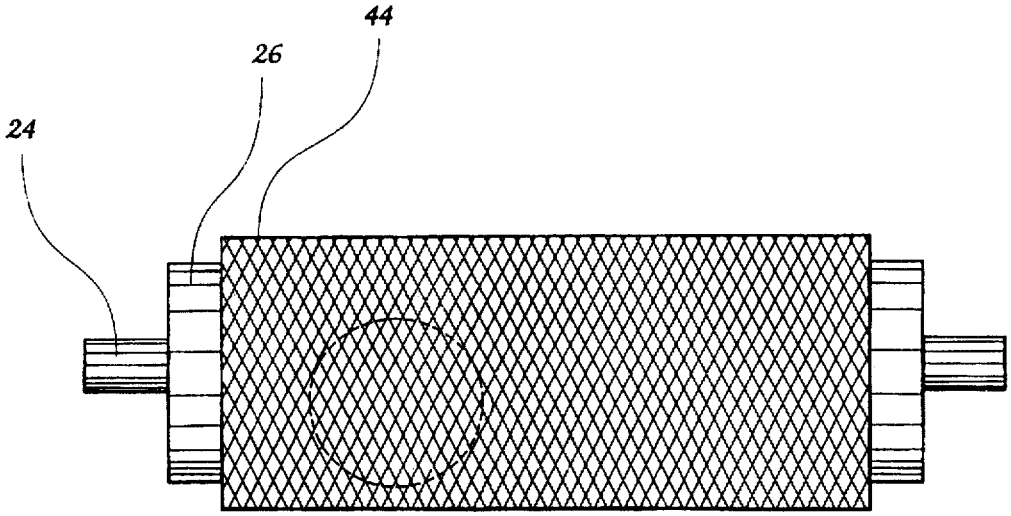
FIG. 4A is an elevational view of a yarn package improperly wound revealing the repetitive patterns on the yarn surface.
Figure 4B:
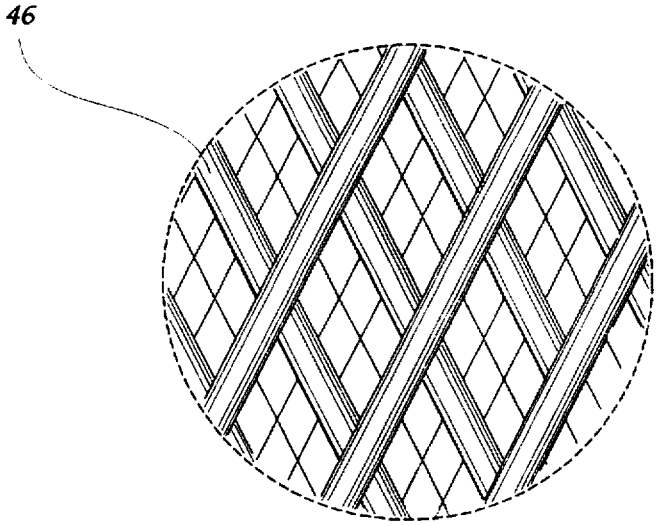
FIG. 4B is a detailed view of the surface of the yarn package illustrated in 4A.

As can be seen in FIG. 3, a proper random wind of a yarn package 40 offers a pattern 42 where individual winds or individual strand segments defined by circumventions of the yarn package are laid in a random manner, thereby randomly distributing the tension throughout the package and reducing the tendency of the winds to fuse together. As seen in FIG. 4, an improperly wound package 44 includes a series of repetitive patterns 46 seen as closely adjacent parallelly oriented winds. As previously stated, these repetitive patterns can have a detrimental effect on the resultant yarn package.

By the above, the present invention provides a method and apparatus for automatically predicting the occurrence of repetitive patterns of yarn strand segment on a yarn package and providing the necessary operational correction to avoid the patterns' ocurrence.

It will therefore be readily understood by those persons skilled in the art that the present invention is susceptible of a broad utility and application. Many embodiments and adaptations of the present invention other than those herein described, as well asmany variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A method to control the winding pattern on a yarn package for a traverse winder used for winding elastomeric yarn to prevent repetitive patterns of yarn segments on the package, said method comprising the steps of the steps of:

providing means for monitoring the operation of a yarn package spindle includes providing means for counting the number of revolutions experienced by the yarn package spindle;

providing means for monitoring the operation of a traverse arm associated with the traverse winder including providing means for determining the occurrence of a complete traversing movement of the traverse arm associated with the traverse winder, defining a traverse cycle;

providing means for predicting the occurrence of repetitive patterns of yarn segments including providing means for determining a ratio, said ratio being the number of revolutions experienced by the yarn package spindle per traverse cycle to determine a wind ratio and doubling said wind ratio and multiplying the result by a predetermined factor, said factor being an integer, to determine a derived wind ratio and means for predicting when said derived wind ratio will be an integer;

providing means for adjusting the relative speed of traveling yarn being wound on the yarn package spindle and traverse arm includes providing means for changing the speed of the traverse arm;

monitoring the operation of the yarn package spindle including counting the number of revolutions experienced by the yarn package spindle using said means for counting the number of revolutions experienced by the yarn package spindle;

monitoring the operation of the traverse arm including determining the occurrence of traverse cycles using said means for determining the occurrence of a complete traversing movement of the traverse arm associated with the traverse winder;

determining said ratio using said means for determining a ratio, said ratio being the number of revolutions experienced by the yarn package spindle per traverse cycle to determine a wind ratio;

predicting the occurrence of repetitive patterns of yarn segments includes doubling said wind ratio and multiplying the result by a predetermined factor, said factor being an integer, to determine a derived wind ratio and predicting when said derived wind ratio will be an integer using said means for predicting when said wind ratio will be an integer; and adjusting the relative speed of the traveling yarn being wound on yarn package spindle and the traverse arm includes changing the speed of the traverse arm responsive to a determination that the derived wind ratio is approaching an integer.

2. A method to control the winding pattern on a yarn package for a traverse winder according to claim 1 wherein the step of providing means for counting the number of revolutions experienced by the yarn package spindle includes providing a pulse generator associated with the yarn package spindle for generating a predetermined number of pulses for each revolution of the yarn package spindle and providing a pulse counter to detect said pulses.

3. A method to control the winding pattern on a yarn package for a traverse winder according to claim 2 wherein the step of providing means for determining the occurrence of a complete traversing movement of the traverse arm associated with the traverse winder includes providing a pulse generator for producing pulses associated with a traversing movement of the traverse arm.

4. A method to control the winding pattern on a yarn package for a traverse winder according to claim 2 wherein the step of providing means for determining the occurrence of a complete traversing movement of the traverse arm associated with the traverse winder includes providing a pulse generator associated with the traverse arm for generating a predetermined number of pulses for each traverse movement of the traverse arm and providing a pulse counter to detect said pulses determine to the occurrence of a complete traversing movement of said traverse arm.

* * * * *